United States Patent [19]

Kaiko

[11] Patent Number: 4,565,952

[45] Date of Patent: Jan. 21, 1986

[54] SPEED CONTROLLING DEVICE FOR ROLLING MILLS

[75] Inventor: Akira Kaiko, Hyogo, Japan

[73] Assignee: Mitsubishi Denki Kabushiki Kaisha, Tokyo, Japan

[21] Appl. No.: 667,727

[22] Filed: Nov. 2, 1984

[30] Foreign Application Priority Data

Nov. 4, 1983 [JP] Japan ..... 58-207011

[51] Int. Cl.[4] ..... H02P 5/00

[52] U.S. Cl. ..... 318/345 R; 318/6; 318/314; 318/326

[58] Field of Search ..... 318/301, 302, 311, 312, 318/313, 314, 315, 316, 317, 318, 319, 331, 326, 332, 338, 339, 336, 342, 345, 433, 434; 355/14 SH, 14 TR, 3 SH; 271/258, 259; 242/75.51, 75.47, 75.5, 151

[56] References Cited

U.S. PATENT DOCUMENTS

| | | | |
|---|---|---|---|
| 3,029,373 | 4/1962 | Holman | 318/317 |
| 3,211,983 | 10/1965 | Dolphin | 318/308 X |
| 3,416,058 | 12/1968 | Hill et al. | 318/366 X |
| 3,428,877 | 2/1969 | Campbell et al. | 318/314 X |
| 3,614,572 | 10/1971 | Usher | 318/326 X |
| 3,657,623 | 4/1972 | Fludzinski | 318/326 |
| 3,762,663 | 10/1973 | Nedreski | 318/6 X |
| 3,789,286 | 1/1974 | Towne et al. | 318/302 X |
| 4,126,817 | 11/1978 | Luzio | 318/6 X |
| 4,230,975 | 10/1980 | Donatelli et al. | 318/338 X |
| 4,280,081 | 7/1981 | Dinger et al. | 318/331 X |
| 4,310,153 | 1/1982 | Kikuchi | 271/259 |
| 4,316,131 | 2/1982 | Miyamoto et al. | 318/614 X |

FOREIGN PATENT DOCUMENTS

| | | |
|---|---|---|
| 53-49689 | 6/1978 | Japan . |
| 58-40437 | 2/1983 | Japan . |

*Primary Examiner*—Bernard Roskoski
*Assistant Examiner*—Shik Luen Paul Ip
*Attorney, Agent, or Firm*—Bernard, Rothwell & Brown

[57] ABSTRACT

A device for controlling a speed of rolls of a rolling mill is disclosed which includes means for reducing an amount of drop of the speed of the rolls and a speed restoration time when a work to be rolled is introduced between the rolls.

3 Claims, 7 Drawing Figures

SPEED CONTROLLING DEVICE FOR ROLLING MILLS

BACKGROUND OF THE INVENTION

1. Field of the Invention

This invention relates to a speed controlling device for a rolling mill for minimizing a variation of a speed of rolls when a work to be rolled is introduced into the rolling mill.

2. Description of the Prior Art

Generally, a speed controlling device for a rolling mill is constructed as shown in FIG. 1. In particular, referring to FIG. 1, reference numeral 1 designates a work to be rolled, 2 a roll for rolling the work 1 to be rolled, 3 an electric motor for driving the rolls 2, 4 a rotational speed detector for detecting a rotational speed of the electric motor 3, 5 a reference speed signal, and 6 a speed controlling operational amplifier for receiving a signal representative of a rotational speed of the electric motor 3 from the rotational speed detector 4 to control the electric motor 3 to maintain a speed indicated by the reference speed signal. Reference numeral 7 denotes a current controlling device, 8 a current controlling signal developed from the operational amplifier 6, 9 a gate firing phase signal developed from the current controlling device 7, 10 a gate firing circuit, 11 a thyristor power supply unit for supplying power to the electric motor 3, and 12 a load current detector for detecting a load current flowing from the thyristor power supply unit 11 to the electric motor 3.

The control system of FIG. 1 can be represented in the form of a block diagram as illustrated in FIG. 2. Referring to FIG. 2, reference numeral 6' corresponds to the speed controlling operational amplifier 6 of FIG. 1, 7' to the current controlling device 7 of FIG. 1, and 8' to the current controlling signal 8. On the other hand, reference numeral 10' corresponds to the gate firing circuit 10 and the thyristor power supply unit 11 of FIG. 1, and a gain of a firing angle controlling section and a thyristor device of the same is represented by K. Further, reference numeral 3' corresponds to the electric motor 3 of FIG. 1.

Other reference numerals in FIG. 2 are listed below:

S; a Laplacean $K_I$; a reset time of the current controlling section

K; a gain of the firing angle controlling section and the thyristor device

Ka; a constant regarding resistance of an armature

Ta; a time constant of an armature of the electric motor

Kc; a coefficient of induction

Km; moment of inertia of the electric motor and the rolls as a whole $T_L$; load torque caused by rolling Ks; a proportional gain of the speed controlling section Ts; a proportional integration time constant of the speed controlling section Referring again to the block diagram of FIG. 2, a transfer function from a speed N of the rolling mill to a joining point of outputs of the firing angle controlling section and the thyristor device both designated at 10' as a whole which presents the gain K, that is, a transfer function from the speed controlling operational amplifier 6 to the gate turning on circuit 10, is greater than the coefficient of induction Kc of the following stage, and hence a feedback loop providing the coefficient of induction Kc can be ignored. Further, a transfer function from an electric current I of the thyristor to a joining point of the current I and the current controlling signal 8' can be represented $$\frac{1}{1 + T_I S}$$

provided $T_I$ can be approximated $$T_I = \frac{1}{\omega_T}$$

where a break point frequency of a transfer function of the round is represented as $\omega_I$.

Accordingly, a transfer function of a speed loop in the block diagram shown in FIG. 2 can be approximated as illustrated in FIG. 3. A Bode diagram in this case is illustrated in FIG. 4.

Generally in an apparatus such as a rolling mill, it is rotated at a fixed speed beforehand, and in this condition, a work to be rolled is introduced into the rolling mill, resulting in sudden application of a load to the rolling mill. Accordingly, where the rolling mill is under automatic speed control, it is commonly known that an electric current and a speed of an electric motor for driving the rolling mill vary as illustrated in FIG. 5. In particular, if a load is applied at a point of time 23, the speed 21 drops. Simultaneously, the current 22 increases to act to restore the speed 21 to an initial preset level. In this instance, an area 24 defined by a dropped amount ΔN of the speed 21 and a time tr required for restoration of the same is used as a unit (index) which indicates a controlling performance of the rolling mill, and in view of characters of the rolling mill, it is considered desirable to minimize such an area 24. Variations of the speed 21 and the electric current 22 change depending upon a load to the electric motor.

In A and B of FIG. 5, an axis of abscissa represents lapse of time t, and an axis of ordinate in A of FIG. 5 indicates a speed N while an axis of ordinate in B of FIG. 5 indicates an electric current I. Reference numeral 21 denotes a variation of the speed, 22 a variation of the electric current, 23 a point of time at which a load is applied, and 24 an area on the drawing until the speed N which has varied returns to its initial level.

Thus, the area 24 defined by the variation ΔN of the speed N and the restoration time tr where a rated load is applied is represented by an equation (1) below.

In particular, referring to FIG. 3, a transfer function G from load torque to a speed is $$G = \frac{Ts \cdot S}{Ts \cdot Km \cdot S^2 + Ks \cdot Ts \cdot S + Ks} \quad (1)$$

However, since $T_I$ is significantly small when compared with $1/\omega_c$ and can be ignored, let $$\rho = \frac{1}{2}\sqrt{\frac{Ks \cdot Ts}{Km}}, \quad \omega = \sqrt{\frac{Ks}{Ts \cdot Km}}$$

then a following equation when the load torque is applied stepwise is obtained $$N = \frac{1}{Km} \cdot \frac{1}{\omega\sqrt{\rho^2 - 1}} e^{-\rho\omega t} \cdot \sinh(\sqrt{\rho^2 - 1}\ \omega t) \quad (2)$$

(provided $\phi > 1$).

Accordingly, the area 24 of FIG. 5 can be obtained by integration of the equation (2) from 0 to Tr. However, since $t > Tr$ and $N \approx N$, it can also be obtained by integration of a following equation (3) from 0 to $\infty$:

$$\text{Area } 24 = \frac{Ts}{Km \cdot \omega c} = \frac{Ts}{Ks} \quad (3)$$

where $\omega c = Ks/Km$.

Hence, the area 24 can be reduced by making the $\omega c$ (or Ks) of the speed loop greater and reducing the time constant Ts of the same. However, values of these $\omega c$ and Ts are normally limited by DC current ripples caused by detection ripples of the rotational speed detector 4.

Ripples which are detected by the rotational speed detector 4 include ripples caused by the detector itself and ripples caused due to an error in centering which remains when the electric motor 3 and the speed detector 4 are connected directly to each other. Both kinds of ripples are produced at a rate of one period/one rotation, and especially ripples of the latter type are produced at a rate of one ripple/one rotation. Since this ripple value $N_R$ is amplified by means of the speed controlling operational amplifier 6, a ripple value $Ks \cdot N_R$ appears in the electric current I.

In a rolling plant, normally a value of an electric current of an electric motor 3 for rolls during rolling is detected as torque generated in order to control the speed or the like of the entire rolling mill, and hence if current ripples increase, then a detection error becomes greater. Also during no load running, the speed is caused to vary by speed detection ripples, resulting in deterioration in preset accuracy before a work 1 to be rolled is introduced between the rolls 2. As a result, $\omega c$ cannot be raised so high, and if $\omega c$ is not raised high, then Ts cannot be reduced so small accordingly.

A speed controlling device for a rolling mill of such a conventional type as described above commonly employs a technique to interpose a correction signal in order to minimize the area 24 defined by the speed N and the restoration time tr of the rolling mill. For example, according to a technique disclosed in a Japanese Patent Publication No. 58-40437, a correction is made to a current controlling signal 8, and according to another technique disclosed in a Japanese Patent Application No. 51-124162, a correction signal is added to a reference speed signal. However, according to those techniques, setting of a constant in each of circuits for producing correction signals is delicate and must be necessarily adjusted while a work is being rolled. Thus, those techniques are disadvantageous in that a long time is required for such adjustment.

SUMMARY OF THE INVENTION

It is an object of the present invention to provide a speed controlling device for a rolling mill which can reduce a variation in speed after a work to be rolled is introduced into the rolling mill and which can realize a speed control of high accuracy by reducing the duration of a variation in speed.

A speed controlling device for a rolling mill according to the invention comprises a speed detector for detecting the speed of an electric motor for rolls of said rolling mill; means for detecting introduction of a work to be rolled between said rolls to output an introduction signal; a speed controlling circuit responsive to an error of an output signal of said rotational speed detector from a prescribed reference speed signal and also to the introduction signal for changing a gain and a time constant of a speed control system of said electric motor; a thyristor device for controlling an electric current flowing through said electric motor; a current detector for detecting an electric current flowing through said electric motor; a current controlling circuit responsive to an error of the output signal of said current detector from a current instruction to said electric motor for outputting a firing phase angle signal to said thyristor device to cancel the error; a rolling pressure detector for detecting a rolling pressure applied to said rolls; a work presence detector for detecting if the work to be rolled is present or not at a time directly before the work is introduced between said rolls; a circuit responsive to an output of said work presence detector and also to an output of said rolling pressure detector for outputting signals representative of rolling pressure before and after introduction of the work to be rolled; and means responsive to output signals of said work presence detector representative of presence or absence of the work to be rolled before and after introduction of the work to be rolled and also to an output signal of said rolling pressure detector for changing the gain and the time constant of said speed controlling circuit to reduce the amount of drop of the speed of said rolls upon introduction of the work to be rolled and to reduce the speed restoration time.

DESCRIPTION OF THE PREFERRED EMBODIMENTS

Figure 1:
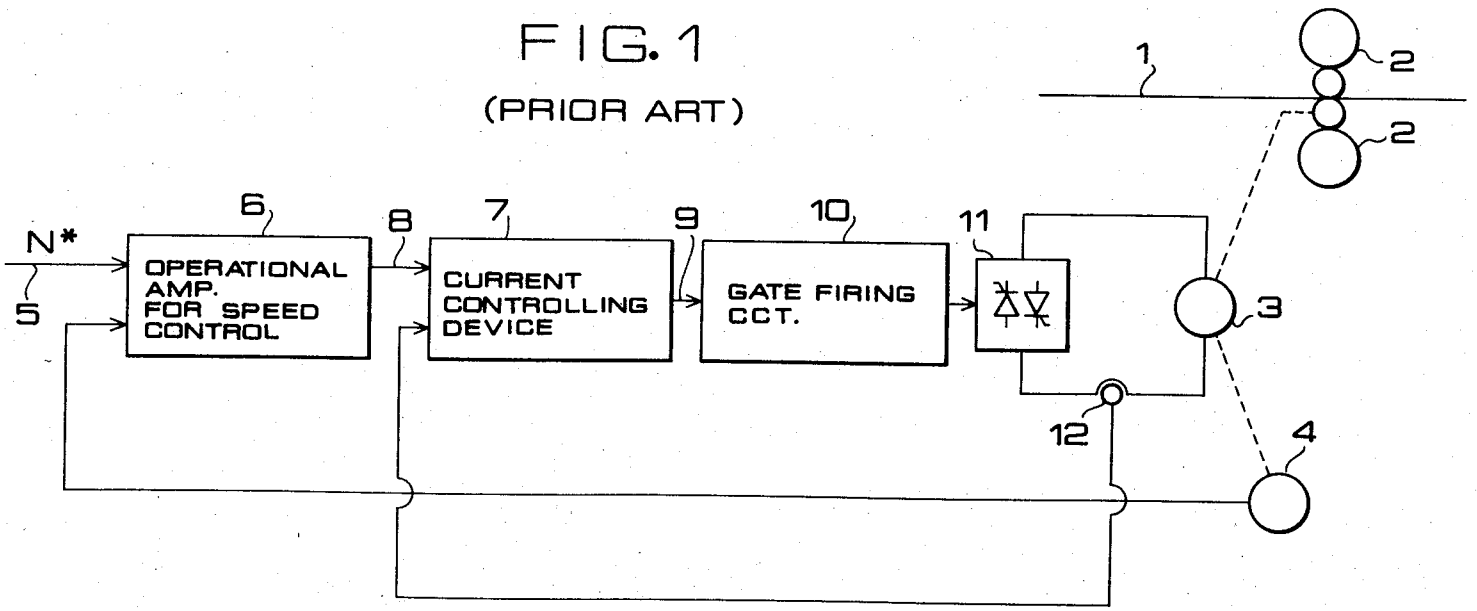
FIG. 1 (PRIOR ART)
FIG. 1 is a block diagram showing a conventional speed controlling device for a rolling mill.
Figure 6:
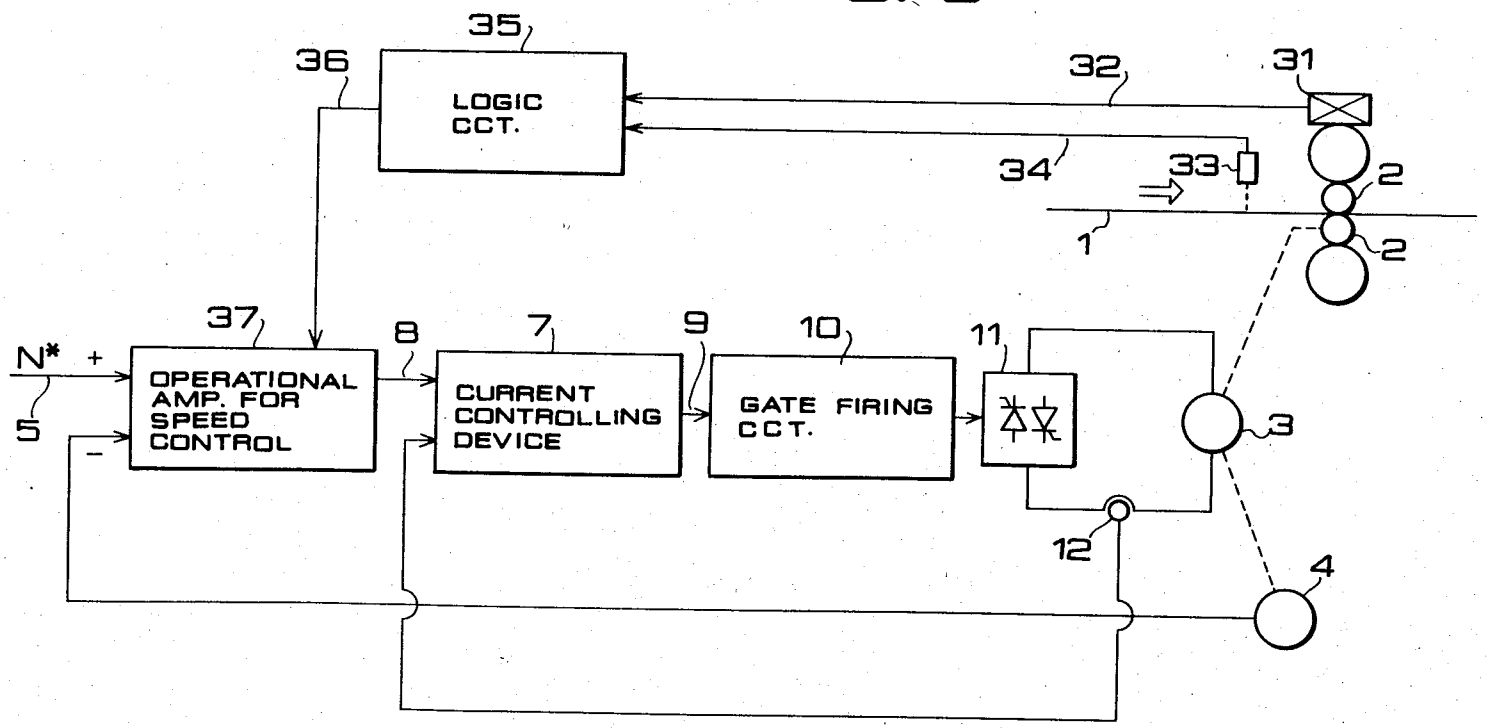
FIG. 6 is a block diagram showing a speed controlling device for a rolling mill according to the present invention.

A preferred embodiment of the present invention will be described below with reference to the accompanying drawings. Referring to FIG. 6 in which equivalent parts are designated by the same reference numerals as those of FIG. 1, reference numeral 31 designates a rolling pressure detector, 32 an output signal of the rolling pressure detector 31, 33 a work position detector disposed directly forwardly of rolls, 34 an output circuit of the work position detector 33, 35 a logic circuit, 36 an output signal of the logic circuit 35, and 37 a speed controlling operational amplifier which can vary a proportional gain Ks and a proportional integration time constant Ts of a speed controlling section in response to the output signal 36 of the logic circuit 35. It is to be noted that an arrow mark which appears above the work 1 in FIG. 6 indicates a direction along which the work to be rolled is transported.

Figure 2:
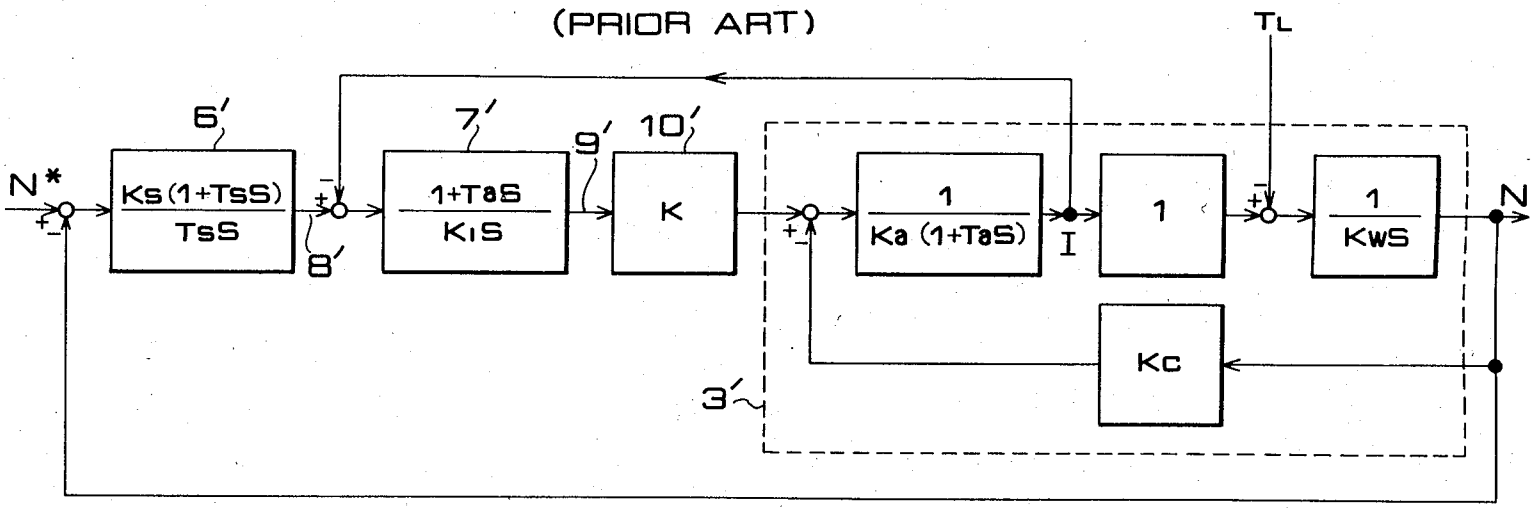
FIG. 2 (PRIOR ART)
FIG. 2 is a block diagram showing a control system of the device of FIG. 1.
Figure 3:
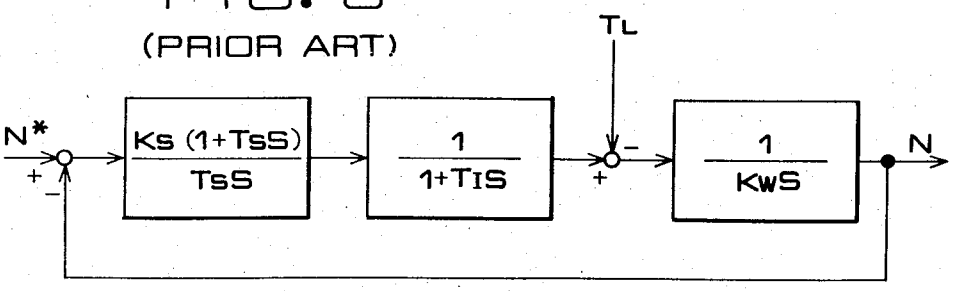
FIG. 3 (PRIOR ART)
FIG. 3 is a block diagram of a speed loop which performs an action approximated to an action of a speed loop of the control system of FIG. 2.
Figure 4:
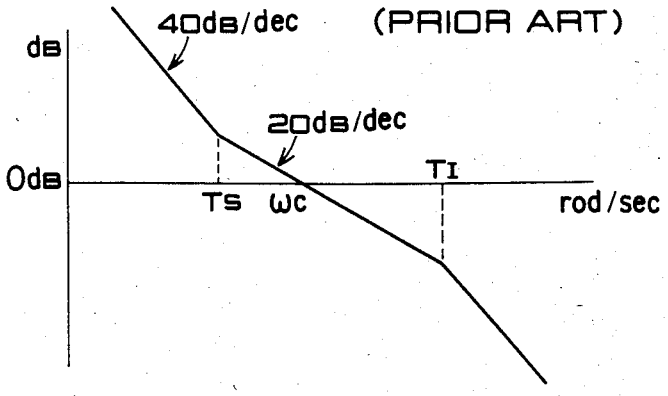
FIG. 4 (PRIOR ART)
FIG. 4 is an open loop Bode diagram of the speed loop of FIG. 3.
Figure 5:
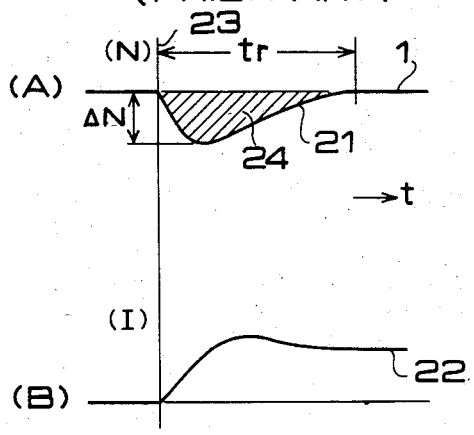
FIG. 5 (PRIOR ART)
FIG. 5 is a diagram showing variations relative to time of a speed and an electric current of the rolling mill at a time when a load is applied.

Now, operations of the device of the invention will be described. At first, the device of the invention controls in such a manner that, when the work 1 to be rolled is introduced between the rolls 2, $\omega c$ is increased while Ts is reduced to reduce the area 24 of FIG. 2, thereby improving performances of the rolling mill as a whole, and during rolling and during idling, $\omega c$ is reduced while Ts is increased to reduce ripples of the speed and electric current.

Figure 7:
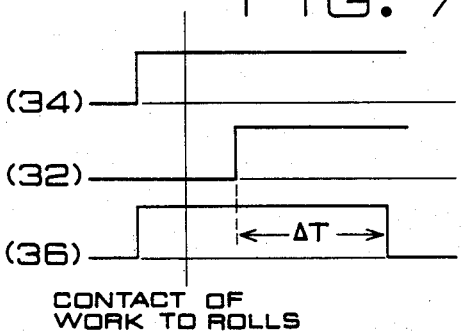
FIG. 7 is a time chart showing relations among outputs of a rolling pressure detector, a work position detector and a logic circuit of the device of FIG. 6 when a work to be rolled is approached to and introduced into the rolling mill.

In particular, the work 1 to be rolled is detected by the work position detector 33 directly before it is introduced into the rolls 2, and thereupon the work position detector 33 outputs a corresponding signal to the output circuit 34 of the work position detector 33 as shown in FIG. 7. Similarly, after the work to be rolled has been introduced into the rolling mill, a pressure is detected by means of the work pressure detector 31 which thus develops an output signal 32. The logic circuit 35 produces a time delay $\Delta T$ of the output signal 32 and delivers an output signal 36 to the speed controlling operational amplifier 37. The speed controlling operational amplifier 37 is represented by a transfer function.

$$\frac{Ks(1 + TsS)}{Ts}$$

which, however, is replaced with first constants $Ks_1$, $Ts_1$ and second constants $Ks_2$, $Ts_2$ by the output signal 36. Referring to FIG. 7, when the output signal 36 of the logic circuit 35 is zero, if the constants $Ks_1$, $Ts_1$ are made 1 and thus $Ks_2$, $Ts_2$, then $$\frac{Ts_1}{Ks_1} < \frac{Ts_2}{Ks_2}$$

and thus the characteristic when the work 1 to be rolled is introduced into the rolling mill is improved.

However, variation of the constants Ks and Ts of the transfer function $$\frac{Ks(1 + TsS)}{Ts}$$

during running has been difficult with an analog type operational amplifier.

Of late, a microprocessor is often applied to speed control of an electric motor employing such a thyristor power supply as described above so that an operation of such a transfer function as described above is effected digitally.

If an interval of time between repetitions of the operation is $\Delta t$, an input of the transfer function for the ith time is Vi, and an output of the same is Vo, then $$Vo = \sum_{n=1}^{i-1} \frac{Ks}{2Ts} \cdot \Delta t(Vn - V_{n-1}) + \frac{Ks}{2Ts} \Delta t(Vi - V_{i-1}) + KVi \quad (4)$$

When replacement signals for Ks, Ts are received for the ith time, if there is no disturbance nor change of the reference speed signal, the second term in the right side of the equation (4) becomes $\neq 0$ since $Vi \neq V_{i-1}$. Accordingly, even if replacement of Ks, Ts is performed for the (i−1)th time and for the ith time, a variation of the output Vo of the transfer function is small and hence there hardly occurs a shock due to such replacement.

While, in the example described above, variation of constants is effected between a mode for introduction and a different mode other than for introduction, it is apparent that variation of constants among three different modes for idling, for introduction and for rolling is also possible by varying the logic circuit 35 and the speed controlling operational amplifier 37 of FIG. 6. In this case, accuracy in setting the speed can be further improved by changing the constants during idling to reduce $\omega c$.

As apparent from the foregoing description, according to the present invention, by increasing a gain and reducing a time constant of a speed controlling circuit when a work to be rolled is introduced into a rolling mill, an area defined by an amount $\Delta N$ of drop of the rotational speed of the rolling mill which appears upon such introduction and also by a speed restoration time tr can be adjusted easily and thus be minimized. Accordingly, the present invention has an effect that variation in rotation of rolls of a rolling mill can be restricted with high accuracy.

What is claimed is:

1. A speed controlling device for a rolling mill, comprising:

a speed detector for detecting the speed of an electric motor for rolls of said rolling mill;

a rolling pressure detector for detecting a rolling pressure applied to said rolls and for detecting introduction of a work to be rolled between said rolls to output an introduction signal;

a speed controlling circuit responsive to an error of an output signal of said rotational speed detector from a prescribed reference speed signal and to the introduction signal for changing a gain and a time constant of a speed control system of said electric motor;

a thyristor device for controlling an electric current flowing through said electric motor;

a current detector for detecting an electric current flowing through said electric motor;

a current controlling circuit responsive to an error of the output signal of said current detector from a current instruction to said electric motor for outputting a firing phase angle signal to said thyristor device to cancel the error;

a work presence detector for detecting if the work to be rolled is present or not at a time directly before the work is introduced between said rolls;

a circuit responsive to an output of said work presence detector and also to an output of said rolling pressure detector for outputting signals respresentative of rolling pressure before and after introduction of the work to be rolled; and means responsive to output signals of said work presence detector representative of presence or absence of the work to be rolled before and after introduction of the work to be rolled and also to an output signal of said rolling pressure detector for changing the gain and the time constant of said speed controlling circuit to reduce the amount of drop of the speed of said rolls upon introduction of the work to be rolled and to reduce the speed restoration time.

2. A speed controlling device according to claim 1, further comprising a circuit responsive to an output of said rolling pressure detector and an output of said work presence detector for outputting a control signal for controlling three different modes for idling of said rolls, for introduction of the work and for rolling, and another circuit responsive to the control signal for changing the gain and the time constant of said speed controlling circuit to control such than the amount of drop of the speed and the speed restoration time are minimum during idling, maximum upon introduction and medial during rolling.

3. A speed controlling device according to claim 2, wherein the operations are controlled by means of a microprocessor.

* * * * *